US011293416B2

(12) United States Patent
Hartmann et al.

(10) Patent No.: US 11,293,416 B2
(45) Date of Patent: Apr. 5, 2022

(54) PRECISION FLUID DISPENSING DEVICE

(71) Applicant: Hartmann's, Inc., Abilene, TX (US)

(72) Inventors: Michael Alan Hartmann, Abilene, TX (US); David Duncan, St. Johns, FL (US)

(73) Assignees: Hartmann's, Inc., Abilene, TX (US); Duncanetics, LLC, St. Johns, FL (US)

( * ) Notice: Subject to any disclaimer, the term of this patent is extended or adjusted under 35 U.S.C. 154(b) by 819 days.

(21) Appl. No.: 16/137,514

(22) Filed: Sep. 20, 2018

(65) Prior Publication Data

US 2019/0084753 A1 Mar. 21, 2019

Related U.S. Application Data

(60) Provisional application No. 62/561,269, filed on Sep. 21, 2017.

(51) Int. Cl.

| | |
|---|---|
| ***B65D 83/00*** | (2006.01) |
| ***F04B 1/00*** | (2020.01) |
| ***F04B 7/06*** | (2006.01) |
| ***F04B 13/00*** | (2006.01) |

(52) U.S. Cl.

CPC ..... *F04B 1/00* (2013.01); *B65D 83/0005* (2013.01); *F04B 7/06* (2013.01); *F04B 13/00* (2013.01)

(58) Field of Classification Search

None

See application file for complete search history.

(56) References Cited

U.S. PATENT DOCUMENTS

| | | | | |
|---|---|---|---|---|
| 3,607,094 | A * | 9/1971 | Beer | B01L 3/0206 422/63 |
| 3,933,048 | A * | 1/1976 | Scordato | B01L 3/0217 73/864.17 |
| 4,172,670 | A * | 10/1979 | Welker | B01L 3/02 366/131 |
| 4,304,138 | A * | 12/1981 | Tervamaki | B01L 3/0234 422/928 |
| 6,143,252 | A * | 11/2000 | Haxo, Jr. | B01J 19/0046 422/131 |
| 6,561,389 | B1 * | 5/2003 | Earle | B65D 47/2075 222/146.5 |
| 10,543,031 | B2 * | 1/2020 | Vogt | B05C 17/00553 |
| 2010/0170921 | A1 * | 7/2010 | Soon | B65D 83/0005 222/389 |
| 2013/0126559 | A1 * | 5/2013 | Cowan | A61M 5/31525 222/333 |

(Continued)

*Primary Examiner* — Brian R Gordon

(74) *Attorney, Agent, or Firm* — Wilson Dutra, PLLC; Camille A. Wilson

(57) ABSTRACT

The present disclosure provides generally for a fluid-dispensing device. More specifically, the present disclosure provides for a precision fluid-dispensing device that may deliver a predefined volume of fluid quickly and reliably. In some aspects, the precision fluid-dispensing device may be used to deliver a fluid to a receiving container, such as in a manufacturing line, as a non-limiting example. In some embodiments, the precision fluid-dispensing device may dispense very accurate volumes of fluid using the head pressure of the fluid from an elevated reservoir or pressurized fluid supply. In some implementations, the precision fluid-dispensing device may dispense fluid gently and quickly, which may allow for handling of fluids that may be sensitive to agitation or mixing.

18 Claims, 7 Drawing Sheets

(56) References Cited

U.S. PATENT DOCUMENTS

| | | | | |
|---|---|---|---|---|
| 2017/0246401 | A1* | 8/2017 | Keenan | A61M 5/31595 |
| 2017/0354965 | A1* | 12/2017 | Cote | B01L 3/0227 |
| 2020/0078808 | A1* | 3/2020 | Lim | A45D 34/00 |
| 2020/0230592 | A1* | 7/2020 | Sauer-Budge | B01L 3/0234 |
| 2021/0048021 | A1* | 2/2021 | Hurst | E21B 43/2607 |

* cited by examiner

PRECISION FLUID DISPENSING DEVICE

CROSS-REFERENCE TO RELATED APPLICATION

This application claims priority to and the full benefit of U.S. Provisional Patent Application Ser. No. 62/561,269, filed Sep. 21, 2017, and titled "PRECISION FLUID DISPENSING DEVICE", the entire contents of which are incorporated in this application by reference.

BACKGROUND OF THE DISCLOSURE

Dispensing systems can deliver precise amounts of fluid in the microliter, or milliliter range. These systems may be used in general manufacturing, pharmaceutical, printing, mixing, drug discovery, materials science, food safety, and forensics. There are a range of possible variations available, including manual or automatic dispensers and designs ranging from single to multi-channel systems. Each design may have tradeoffs. For example, microprocessor-controlled syringe pumps can offer precision and speed but expensive upfront capital and maintenance costs, while peristaltic pumps may reduce back flushing but have high maintenance requirements. Some systems may combine pump types into a single system to reduce the need to purchase multiple instruments. Modular design allows users to change volume range, tip configuration, and dispense heads.

Fluid precision pumping may use a variety of pumping methods, which moves fluids by mechanical action. Peristaltic pumps are a type of positive displacement pump. Positive displacement pumps means a pump makes a fluid move by trapping a fixed amount of the fluid and forcing that trapped volume into a different location. Some positive displacement pumps may instead use an expanding cavity on a suction side and a decreasing cavity on a discharge side. Liquid flows in as one cavity expands and flows out of the discharge side as the cavity collapses.

In particular, peristaltic pumps may contain fluid within a flexible tube that fits inside of a circular pump casing. Rollers, wipers, or shoes may be attached to a rotor that works to compress the flexible tube. When the rotor turns, a part of the tube is compressed, forcing fluid to move through the tube. When the tube opens again, this draws more liquid into the pump.

A diaphragm pump is a positive displacement pump and may also be referred to as a membrane pump. A diaphragm pump may use a combination of the reciprocating action of a diaphragm in conjunction with valves on the side of the diaphragm to pump fluid. These valves are normally shut-off valves, which may include check valves, butterfly valves, or flap valves. For example, the check valve is typically a two-port valve, with an opening for fluid to enter and another for fluid to leave. Check valves normally allow liquids to flow through it in only one direction. There are multiple types of diaphragm types, but the basic principle is that when the diaphragm moves within a chamber, it causes liquid to move. For example, when a diaphragm moves up in a chamber and the volume of the chamber is increased as a result, the pressure decreases, drawing fluid into the chamber. When the diaphragm moves down, pressure is increased as a result of the decreased volume, forcing the previously drawn liquid out. The diaphragm pump then repeats the cycle to push liquids through its chamber. The diaphragm pump typically requires compressed air for the mechanical motion of the diaphragm.

Another positive displacement pump is a piston pump. A piston pump may be a lift pump or a force pump, with each operable either by hand or by a machine. In the lift pump version, one upstroke can draw liquid through a valve into a part of a cylinder. A down stroke can pass this liquid through valves set in the piston to another cylinder. A second upstroke discharges the fluid through a spout. A force pump works similarly, using an inlet valve to draw the fluid into cylinders during an upstroke, and discharging the fluid through an outlet valve during a down stroke.

A subset of the piston pump is the metering pump. Metering pumps move a precise volume of liquid in a specified time period, which provides an accurate volumetric flow rate. These pumps are often used to pump chemicals, solutions, or other liquids. These can be oscillating displacement pumps, where an exact defined volume of liquid may be drawn into a displacement body on a reciprocal stroke. The liquid will then be forced into a metering line on a compression stroke. Metering pumps may be based more on its application or use instead of the exact type of pump being used. Most have a pump head and a motor, with any pumped liquid going through the pump head, entering an inlet line, and exiting through an outlet line. An electric motor is commonly used to drive the pump head, with microprocessors determining the accuracy of the pumps. The motors are typically stepper motors or servo motors paired with a programmable logic controller (PLC) interface integrated into the pump control to fully automate the process. Metering pumps also typically include manual stroke adjustment to change the maximum stroke length and thus dispense volume to the particular needs of the end user. This adjustment requires much time for multiple extrapolation trial measurements and commonly leads to incorrect dose volume due to human error.

Another fluid dispensing method is via a dispensing valve and pressurized reservoir. The valve can be actuated by an electrical or pneumatic solenoid to open for a predetermined time period. The system requires a very consistent fluid pressure supply by means of gravity or pressurized fluid reservoir. Fluid level, tank pressure, tank filling, and valve response time all directly influence the dose accuracy due to the fixed time setting.

Each of these types of pumps has their limitations. For example, the peristaltic pump has low accuracy and low repeatability. They typically require a lot of maintenance with an accompanying high cost and interruption of operation. Diaphragm pumps are also not very accurate and tend to be slow. They are also susceptible to wear and fluid contamination. The diaphragms themselves can fail and leak fluid, while the check valves can also fail frequently depending on fluid type and temperature. Piston pumps are accurate, but slow, since the piston has to retract to charge the next dose depending on the valve used. The valves often fail or do not integrate with certain liquids. Metering pumps have high accuracy and repeatability, but require great expense to maintain and require knowledge of the technical controls since most are programmable and motor driven.

All of these options are expensive, difficult to maintain, and not as accurate as they have the potential to be. Parts and components constantly fail and it is difficult to pinpoint exactly what goes wrong when the complete system is too complex for some production environments. Further, the repeated pumping motion can agitate liquids by pulling on the liquid and then pressurizing the fluid to push it through the system. These systems also require some cycle time to charge or, in the case of pistons, to retract for the next dose. Most are high risk for fluid contamination as they wear.

SUMMARY OF THE DISCLOSURE

What is needed is a single stroke piston with a pressurized fluid supply to provide the least invasive manipulation of fluid with a fast delivery method to the nozzle. A pneumatic rotary motion or electrical solenoid valve may be incorporated to direct the fluid to and from alternating sides of the piston. No adjustment may be needed by an end user since there is a fixed volume as a result of the geometry of the components. This may provide a simpler way to very accurately dispense a solution while minimizing the complexity of the other systems available on the market. Combining simplicity with something like a fixed length ceramic piston may eliminate many of the components used in other systems that may cause failure in the equipment.

This single stroke piston can dispense a very accurate volume of fluid using the head pressure of the fluid in an elevated reservoir or a pressurized fluid supply method. Without check valves, the dispensing device may dispense gently and very quickly. The dispenser may dose and fill at the same time, making a dose as fast as liquid can fill a chamber. The velocity of the discharged fluid is dependent on the nozzle diameter, or by means of a flow control valve. Parts may be autoclave capable for use in a variety of industries that require sanitation. Since some of the parts may be inert, the device can accommodate a variety of fluids currently used in industry. The potential for leakage is minimal as the fluid path is completely enclosed. Users can convert to other dose volumes by simply changing one component of the device. A single moving part minimizes risk of fluid contamination due to debris.

The present disclosure relates to a precision fluid-dispensing device including a lower sleeve including an exterior wall and an interior cavity, a first end cap, a second end cap, where the first end cap and the second end caps are located at distal ends of the lower sleeve, a piston within the interior cavity, a housing configured to contain the lower sleeve and the piston, and a valve manifold, where the valve manifold is configured to fit to the housing. In some aspects, the valve manifold may comprise an upper sleeve and a valve spool, where the valve spool is configured to draw a predefined volume of fluid into the interior cavity.

In some implementations, the valve manifold may comprise a first opening and a second opening, where a first draw of the predefined volume of fluid occurs through the first opening and a second draw occurs through the second opening. In some aspects, the second draw of the predefined volume of fluid concurrently dispenses the predefined volume of fluid through the first opening. In some embodiments, a third draw of a predefined volume of fluid occurs through the first opening, where the third draw concurrently dispenses the predefined volume of fluid through the second opening. In some embodiments, the precision fluid-dispensing device may comprise a rotary cylinder configured to engage the valve spool.

In some implementations, a rotation of the rotary cylinder in a first direction causes the first draw and a rotation of the rotary cylinder in a second direction causes the second draw. In some aspects, the precision fluid-dispensing device may comprise an attachment mechanism connecting the rotary cylinder to the valve manifold. In some implementations, the attachment mechanism may comprise an adhesive. In some aspects, the attachment mechanism may comprise a mechanical fastener. In some embodiments, the first draw of the predefined volume of fluid moves the piston to the first end cap and the second draw of the predefined volume of fluid moves the piston to the second end cap.

In some implementations, the precision fluid-dispensing device may comprise a base connected to a portion of one or both the housing and the valve manifold. In some embodiments, the base may be anchorable to a foundation. In some aspects, the precision fluid-dispensing device may comprise a first gasket configured to limit leakage of fluid flow between the housing and the valve manifold. In some embodiments, the predefined volume of fluid may be drawn from an external source. In some aspects, the external source may comprise a pressurized fluid reservoir.

In some implementations, the predefined volume of fluid may be defined by a size of the interior cavity, a size of the first end cap, and a size of the second end cap. In some aspects, the predefined volume of fluid may be defined by a size of the piston. In some implementations, one or more of the first end cap, second end cap, and piston are interchangeable with variable sizes, where the variable sizes change the predefined volume of fluid. In some embodiments, the piston may comprise an inert material. In some aspects, at least a portion of the precision fluid-dispensing device may be autoclavable.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1:
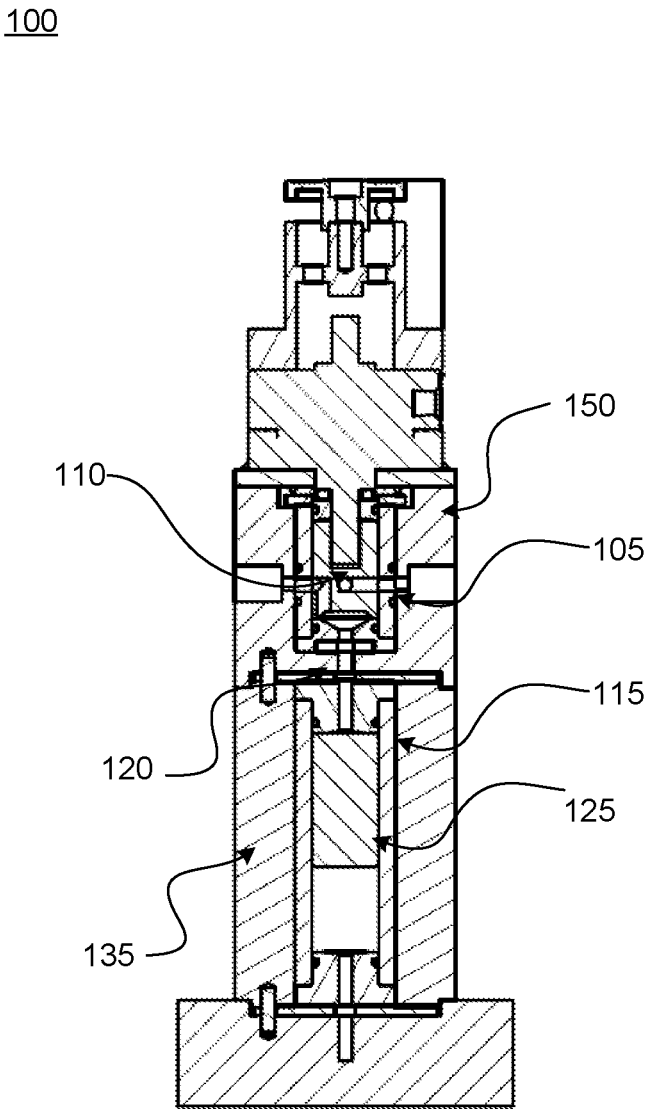
FIG. 1 illustrates a cross section of an exemplary precision fluid-dispensing device.

The present disclosure provides generally for a fluid-dispensing device. More specifically, the present disclosure provides for a precision fluid-dispensing device that may deliver a predefined volume of fluid quickly and reliably. In some aspects, the precision fluid-dispensing device may be used to deliver a fluid to a receiving container, such as in a manufacturing line, as a non-limiting example.

In some embodiments, the precision fluid-dispensing device may dispense very accurate volumes of fluid using the head pressure of the fluid from an elevated reservoir or fluid supply pressurized by other means. In some aspects, the precision fluid-dispensing device may not comprise check valves, which may allow for more frequent use with limited need for adjustments and maintenance due to component wear and failure. In some implementations, the precision fluid-dispensing device may dispense fluid gently and quickly, which may allow for handling of fluids that may be sensitive to agitation or mixing such as degassing.

In some aspects, the precision fluid-dispensing device may receive fluid supply from an elevated container, such as a gravity head, or from a pressurized fluid reservoir through a port under minimal pressure, which may create flow. The precise configuration of the fluid supply may vary based on the viscosity of the fluid being dispensed. In some aspects, the pressurized fluid may enter a draw opening, which may be directed by solenoid valves or a rotary valve or actuator to an end of the lower sleeve cavity. In some implementations, the piston may comprise a fixed length, wherein the fixed length may at least partially determine the volume draw. In some embodiments, the piston motion in the lower sleeve may push out the fluid captured in a cavity on the other side of the piston from a previous draw.

In some aspects, the fluid may exit from the same upper sleeve through a dispensing opening. In some implementations, the upper sleeve may be adapted with an individual direct dispensing nozzle or tube fitting to transfer fluid to a remote nozzle location. In some embodiments, the side of the piston exposed to the pressurized fluid is alternated, such as through an electronic solenoid valve or pneumatic rotating valve, which may limit the need to retract the piston for subsequent draws and doses.

In some embodiments, the components of the precision fluid-dispensing device may be inert, which may allow for dispensing of aggressive fluids, such as deionized water, alcohols, inks, and caustic fluids, as non-limiting examples, that may be problematic to current dispensing systems. In some aspects, the precision fluid-dispensing device may comprise a closed fluid path, which may limit the risk of leakage.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Precision fluid-dispensing device: as used herein refers to a mechanism for drawing and dispensing one or more fluids.

Volume Draw: as used herein refers to a volume of fluid drawn into a precision fluid-dispensing device, wherein the volume of fluid drawn is equal to the volume of fluid subsequently dispensed.

Referring now to FIG. 1, a cross-section of an exemplary precision fluid-dispensing device 100 is illustrated. In some embodiments, a precision fluid-dispensing device 100 may comprise a valve manifold 150 that may house an upper sleeve 105 and a valve spool 110, wherein the valve spool 110 may draw fluid into the precision fluid-dispensing device 100. In some aspects, the precision fluid-dispensing device 100 may comprise housing 135 that may contain a lower sleeve 115 and piston 125, wherein the lower sleeve 115 may comprise end caps 120 located at distal ends of the lower sleeve 115.

In some implementations, the valve spool 110 may draw fluid through the upper sleeve 105 into the housing 135, wherein the fluid will fill a cavity 130 to a predefined volume. In some aspects, the predefined volume may be based on the size of one or more of the lower sleeve 115, the piston 125, and the end caps 120. In some embodiments, once filled to the predefined volume, a subsequent draw of fluid may dispense the predefined volume of fluid. In some aspects, the piston 125 may comprise a ceramic or other inert material, which may limit or reduce the risk of the piston 125 interacting with the fluid.

Figure 2C:
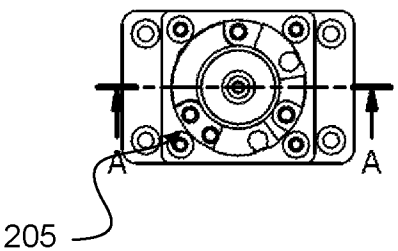
FIG. 2C illustrates a top down view of an exemplary precision fluid-dispensing device.
Figure 2B:
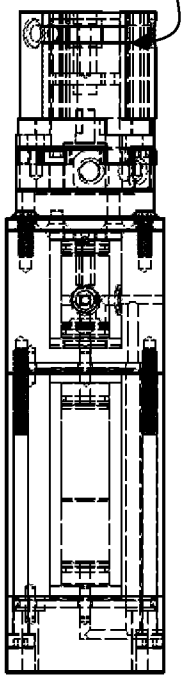
FIG. 2B illustrates a side view of an exemplary precision fluid-dispensing device.
Figure 2A:
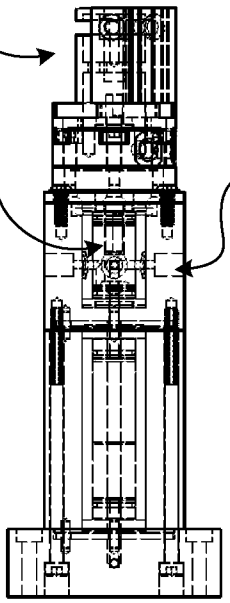
FIG. 2A illustrates a front view of an exemplary precision fluid-dispensing device.

Referring now to FIG. 2A, a front view of an exemplary precision fluid-dispensing device 200 is illustrated. In some aspects, the precision fluid-dispensing device 200 may comprise a rotary cylinder 205 that may engage the valve spool 215. In some embodiments, the rotary cylinder 205 may be attached to the valve manifold 210. In some implementations, the precision fluid-dispensing device 200 may be anchored by a base 220. Referring now to FIG. 2B, a side view of an exemplary precision fluid-dispensing device 200 is illustrated. Referring now to FIG. 2C, a top down view of an exemplary precision fluid-dispensing device 200 is illustrated.

Figure 3:
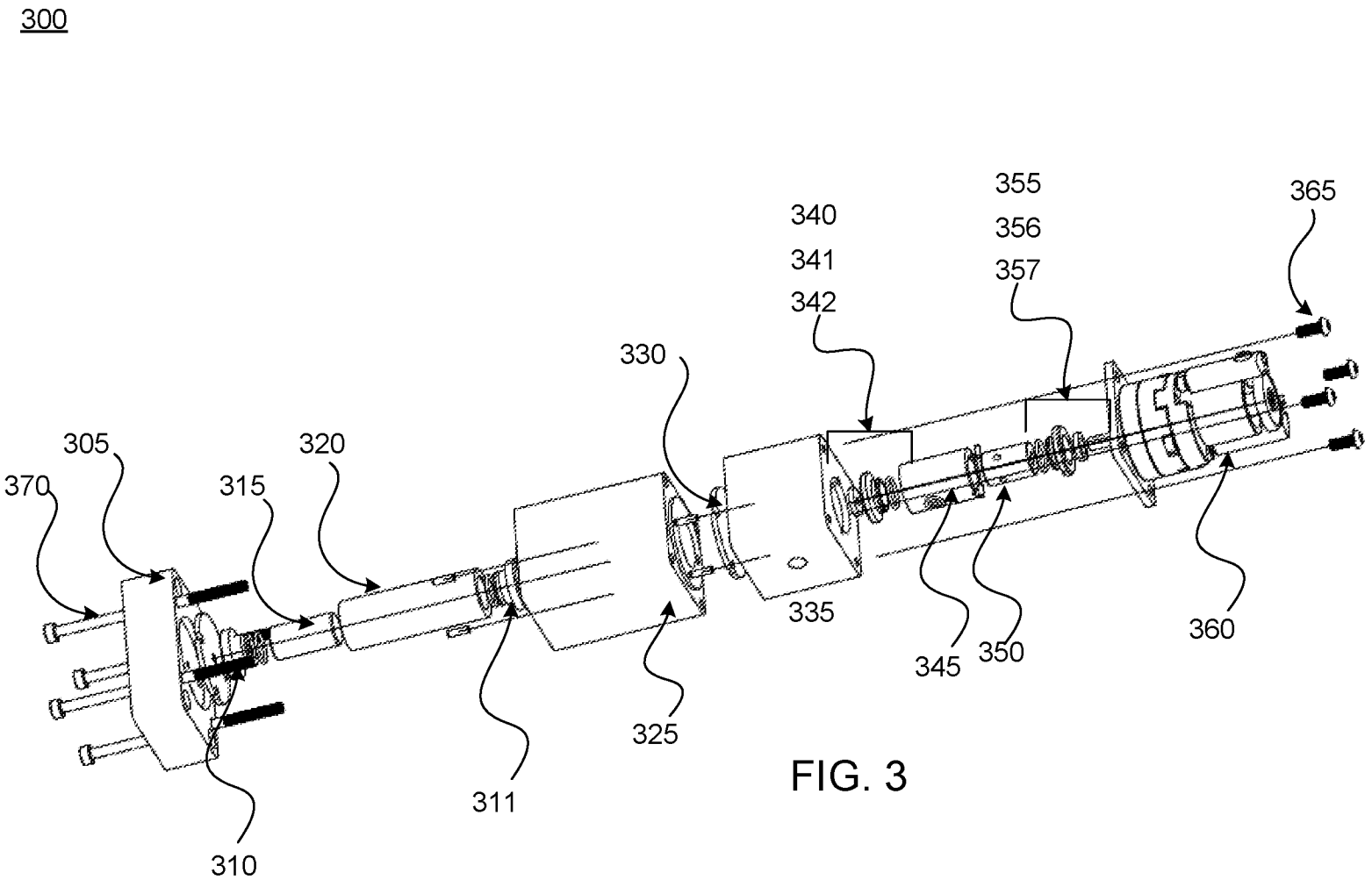
FIG. 3 illustrates an exploded view of an exemplary precision fluid-dispensing device.

Referring now to FIG. 3, an exploded view of an exemplary precision fluid-dispensing device 300 is illustrated. In some aspects, the precision fluid-dispensing device 300 may comprise a base 305, which may be anchored to a foundation through anchoring mechanisms 370, such as screws. In some embodiments, the precision fluid-dispensing device 300 may comprise housing 325 that may be attached to the base 305. In some implementations, the housing 325 may comprise a lower sleeve 320 containing a piston 315, wherein the lower sleeve 320 may comprise end caps 310, 311 at distal ends.

In some aspects, the housing 325 may fit to the valve manifold 335, wherein a gasket 330 may secure the fitting, limiting leakage of fluid when flowing between the valve manifold 335 and the housing 325. In some embodiments, the valve manifold 335 may comprise an upper sleeve 345 with a valve spool 350, wherein each distal end of the upper sleeve 345 may comprise a gasket 340, 357, a cap end 341, 356, and an o-ring 342, 355. In some implementations, the precision fluid-dispensing device 300 may comprise a rotary cylinder 360, which may be connected to the valve manifold 335 through an attachment mechanism 365, such as screws or adhesives, as non-limiting examples.

Figures 4A, 4B, 4C, 4D, 4E, 4F, 4G:
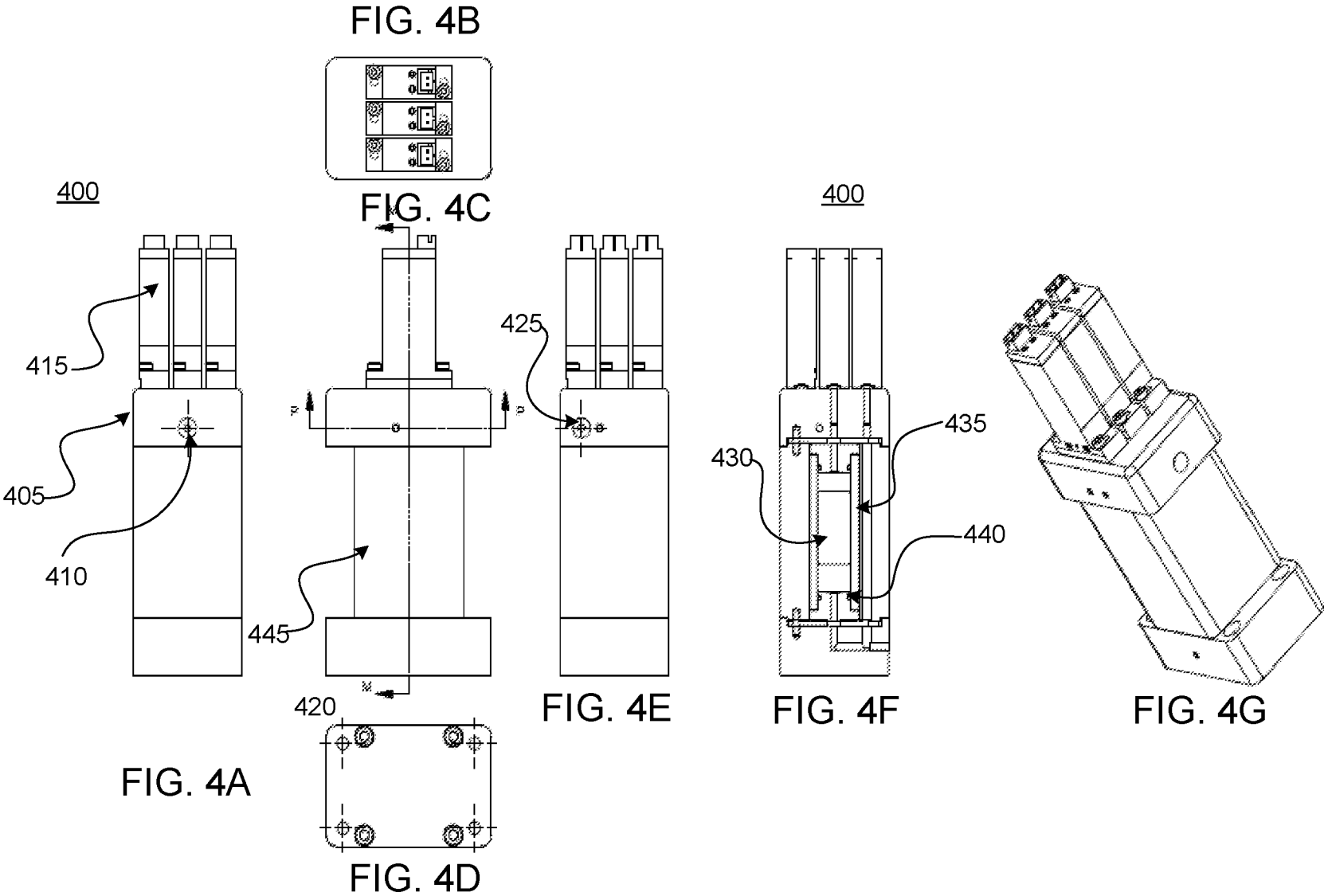
FIG. 4A illustrates a side view of an alternate exemplary precision fluid-dispensing device.
FIG. 4B illustrates a top down view of an alternate exemplary precision fluid-dispensing device.
FIG. 4C illustrates a front view of an alternate exemplary precision fluid-dispensing device.
FIG. 4D illustrates a bottom up view of an alternate exemplary precision fluid-dispensing device.
FIG. 4E illustrates a second side view of an alternate exemplary precision fluid-dispensing device.
FIG. 4F illustrates a cross section view of an alternate exemplary precision fluid-dispensing device.
FIG. 4G illustrates a perspective view of an alternate exemplary precision fluid-dispensing device.

Referring now to FIG. 4A, a side view of an alternate exemplary precision fluid-dispensing device 400 is illustrated. In some aspects, a valve system 415 may be attached to the valve manifold 405. In some embodiments, the valve manifold 405 may comprise a dispensing opening 410. Referring now to FIG. 4B, a top down view of an alternate exemplary precision fluid-dispensing device 400 is illustrated.

Referring now to FIG. 4C, a front view of an alternate exemplary precision fluid-dispensing device 400 is illustrated. In some aspects, the housing 445 may be attached to a base 420. In some embodiments, the valve manifold 405 may comprise a receiving opening 425 and a dispensing opening 410, through which fluid may flow. Referring now to FIG. 4D, a bottom up view of an alternate exemplary precision fluid-dispensing device 400 is illustrated.

Referring now to FIG. 4E, a second side view of an alternate exemplary precision fluid-dispensing device 400 is illustrated. Referring now to FIG. 4F, a cross section view of an alternate exemplary precision fluid-dispensing device 400 is illustrated. In some aspects, the housing 445 may contain a lower sleeve 435 and piston 430. In some embodiments, the lower sleeve 435 may comprise end caps 440 at distal openings of the lower sleeve 435. Referring now to FIG. 4G, a perspective view of an alternate exemplary precision fluid-dispensing device 400 is illustrated.

Figure 5B:
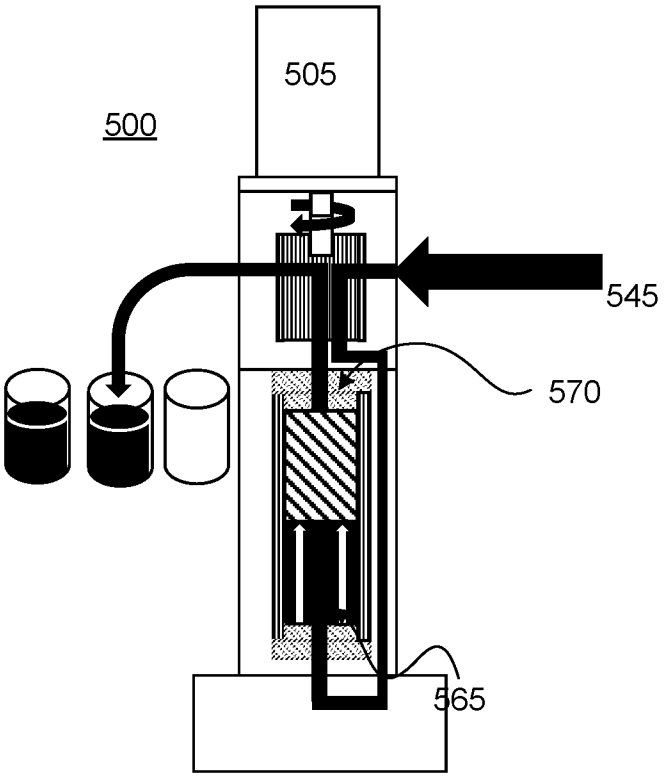
FIG. 5B illustrates a cross section view of fluid flow through an exemplary precision fluid-dispensing device.
Figure 5A:
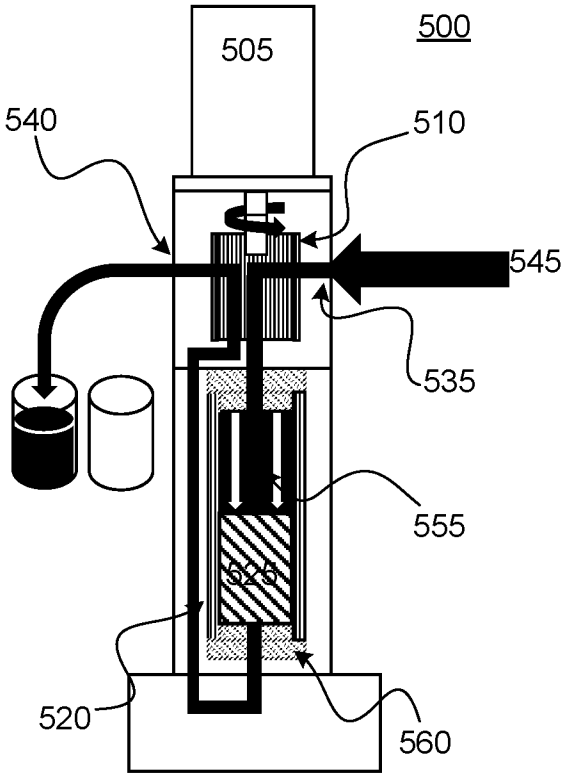
FIG. 5A illustrates a cross section view of fluid flow through an exemplary precision fluid-dispensing device.

Referring now to FIGS. 5A-5B, a cross section view of fluid flow through an exemplary precision fluid-dispensing device 500 is illustrated. In some aspects, fluid 545 may be drawn from an external source through a receiving opening 535. In some embodiments, the external source may comprise an elevated container or pressurized fluid reservoir. In some implementations, turning the rotary cylinder 505 may engage the valve spool 510, which may draw in fluid. In some implementations, a clockwise turn of the rotary cylinder 505 from a predefined angle may cause a first draw, and a counterclockwise turn of the rotary cylinder 505 from a predefined angle may cause a second draw, wherein repeated turns of the rotary cylinder 505 may allow for repeated draws of a fixed volume of the fluid 545.

In some aspects, a first draw may draw fluid 545 through the valve spool 510 into a first cavity 555 in the lower sleeve 520, wherein the first cavity 555 may be created when the piston 525 is located against a first end cap 560. In some embodiments, a second draw may dispense the fluid from the first draw through a dispensing opening 540. The second draw may draw fluid into a second cavity 565 in the lower sleeve 520, wherein the second cavity 565 may be created when the piston 525 is located against a second end cap 570.

Figure 6B:
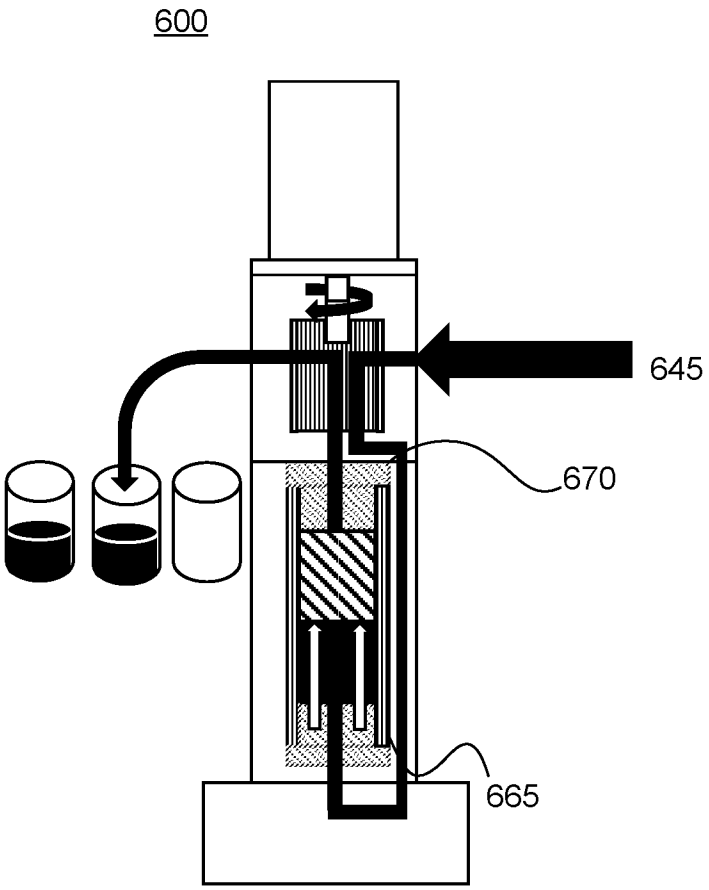
FIG. 6B illustrates a cross section view of fluid flow through an alternate exemplary precision fluid-dispensing device.
Figure 6A:
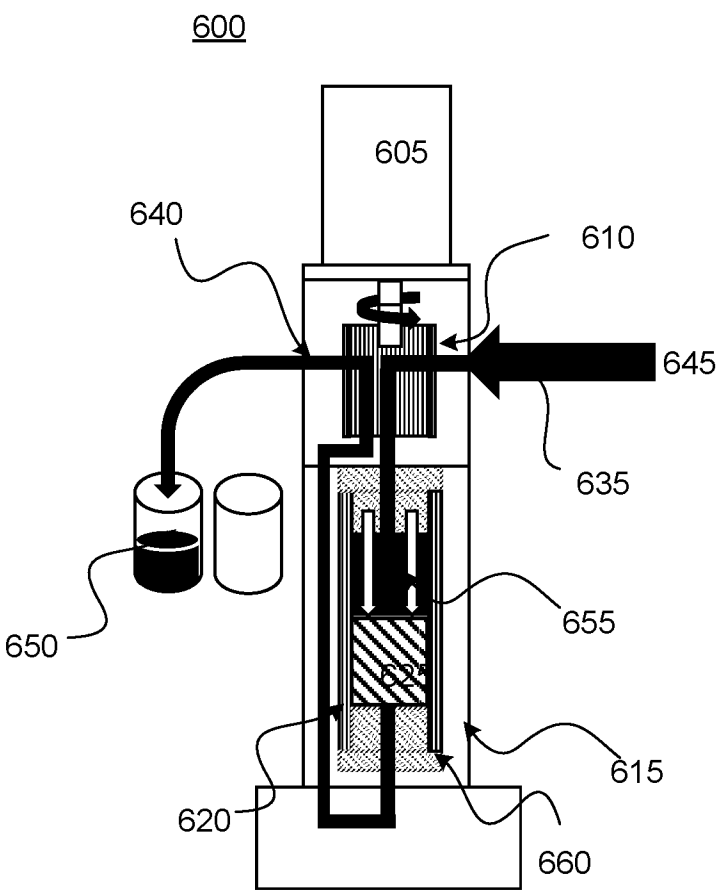
FIG. 6A illustrates a cross section view of fluid flow through an alternate exemplary precision fluid-dispensing device.

Referring now to FIGS. 6A-6B, a cross section view of fluid flow through an exemplary precision fluid-dispensing device 600 is illustrated. In some aspects, fluid 645 may be drawn from an external source through a receiving opening 635. In some implementations, turning the rotary cylinder 605 may engage the valve spool 610, which may draw in fluid 645. In some implementations, a clockwise turn of the rotary cylinder 605 from a predefined angle may cause a first draw, and a counterclockwise turn of the rotary cylinder 605 from a predefined angle may cause a second draw, wherein repeated turns of the rotary cylinder 605 may allow for repeated draws of a fixed volume of the fluid 645.

In some embodiments, the volume of fluid drawn may be determined by the size of one or more of the housing 615, the lower sleeve 620, the piston 625, and the long end caps 660, 670. For example, as illustrated in FIGS. 5A-5B, shorter end caps may allow for a larger volume of fluid draw as compared to the volume of fluid draw with the long end caps 660, 670 of FIGS. 6A-6B. Similarly, a larger lower sleeve and a smaller piston may allow for a larger volume draw.

In some aspects, a first draw may draw fluid 645 through the valve spool 610 into a first cavity 655 in the lower sleeve 620, wherein the first cavity 655 may be created when the piston 625 is located against a first long end cap 660. In some embodiments, a second draw may dispense the fluid from the first draw through a dispensing opening 640. The second draw may draw fluid into a second cavity 665 in the lower sleeve 620, wherein the second cavity 665 may be created when the piston 625 is located against a second long end cap 670.

In some implementations, one or more components may be interchangeable, which may allow for a range of volumes to be drawn from a precision fluid-dispensing device 600. For example, a series of precision fluid-dispensing devices 600 may be utilized on a manufacturing line, wherein each of the precision fluid-dispensing devices 600 may dispense into separate containers 650. Interchangeable components may allow for periodic or batch adjustments of volume draws. In some aspects, the volume draws within the series may be different, such as where the containers 650 to be filled may comprise different volumes. In some embodiments, the volume draws within the series may be the same but may be changed periodically for different batches.

In some embodiments, the size of the receiving openings and dispensing openings may vary depending on a number of factors, such as speed of draw, fluid properties (e.g. viscosity, temperature, and density), and draw volume, as non-limiting examples. For example, the dispensing openings for dispensing chemical additives may be larger than those for dispensing one ounce of nail polish.

In some aspects, the precision fluid-dispensing device 600 may be utilized by consumers, which may have different use requirements, as compared to where it may be used in manufacturing. For example, the precision fluid-dispensing device 600 may be used to dispense consumable fluids, such as sodas, liquors, wine, or coffee, as non-limiting examples, which may mean the precision fluid-dispensing device 600 may need to be comprised of food safe materials. In some implementations, the precision fluid dispensing device 600 may be incorporated into pre-existing beverage machines, like a coffee pourer, to provide for a more controlled release. It may also be desirable to have a configuration for easy disassembly, which may allow for easy cleaning between uses, when changing fluids, or for sanitation in an autoclave.

In some embodiments, not shown, the precision fluid-dispensing device 600 may comprise one or more sensors, which may provide feedback and confirmation of actuation. In some implementations, the piston may have a metal or magnetic insert that may be picked up by an external switch incorporated in the housing. For example, within a production environment, it may be throughput advantage for the control system to know more accurately when the dose is complete versus a fixed timer.

In some embodiments (not shown) the precision fluid-dispensing device 600 may be coupled with a precision scale, which may indicate the precise volume by weight dispensed at each container by subtracting a known container weight from total weight of the container with dose. A scale reading may allow for tracking of the quality of dosing and ensure that the intended volume matches the sensed volume. A precision scale may be particularly useful where one or more of the components may be interchangeable to adjust draw volume.

In some aspects, sensors may provide feedback to indicate maintenance requirements. For example, the sensors may detect internal buildup of fluid within the precision fluid-dispensing device 600, such as within the housing 615 or lower sleeve 620. In some implementations, inconsistent volume feedback may indicate a need to assess the precision fluid-dispensing device 600.

Figure 7:
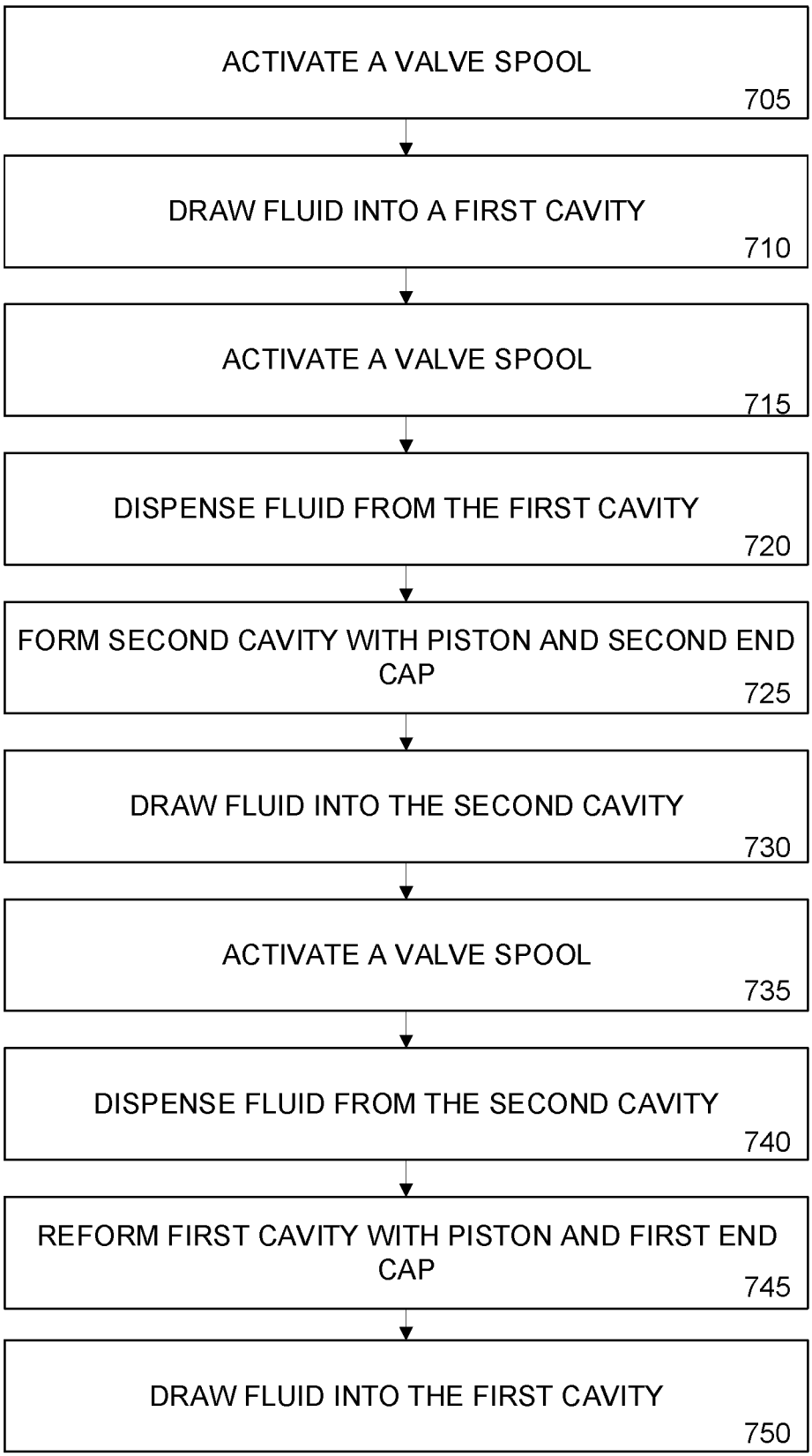
FIG. 7 illustrates exemplary method steps for drawing and dispensing fluid, according to some embodiments of the present disclosure.

Referring now to FIG. 7, exemplary method steps for drawing and dispensing fluid are illustrated. At 705, a valve spool may be activated. At 710, fluid may be drawn into a first cavity, wherein the first cavity may be formed with the first end cap and the piston located distally within the interior of the interior cavity. At 715, a valve spool may be activated, wherein the activation mechanism may be the same or different than the activation mechanism engaged at 705.

At 720, fluid from the first cavity may be dispensed. In some aspects, the fluid may be dispensed by the movement of the piston from one end of the interior cavity to the opposite end. At 725, a second cavity may be formed with the second end cap and the piston. At 730, fluid may be drawn into the second cavity. In some embodiments, the fluid may be drawn into the second cavity concurrently with the dispensing of the fluid from the first cavity at 720.

At 735, a valve spool may be activated. At 740, fluid from the second cavity may be dispensed. At 745, the first cavity may be reformed with the piston and the first end cap. At 750, fluid may be drawn into the first cavity. In some implementations, the steps at 740, fluid may be dispensed from the second cavity, at 745, the first cavity may be reformed, and at 750, fluid may be drawn into the first cavity, may occur concurrently. The movement of the piston from the first end cap to the opposite end of the interior cavity against the second end cap may simultaneously dispense fluid, reform the first cavity, and draw fluid into the first cavity.

In some aspects, this process may be repeated as needed to dispense fluids into manufacturing units. In some embodiments, the components may be interchangeable, which may allow for a predefined range of volumes to be dispensed. In some embodiments, one or more the piston size or end cap sizes may be exchanged between manufacturing runs to allow for multiple size containers of the fluid.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A precision fluid-dispensing device comprising:
- a lower sleeve comprising an exterior wall and an interior cavity;
- a first end cap;
- a second end cap, wherein the first end cap and the second end cap are respectively attached to opposing distal ends of the lower sleeve;
- a piston within the interior cavity;
- a housing containing the lower sleeve and the piston;
- a valve manifold, wherein the valve manifold is attached to an upper end of the housing, the valve manifold comprising:
  - an upper sleeve; and
  - a valve spool, wherein the valve spool is in the upper sleeve and the upper sleeve is fluidically coupled to the interior cavity and configured to draw a predefined volume of fluid into the interior cavity.

2. The precision fluid-dispensing device of claim 1, wherein the valve manifold further comprises a first opening and a second opening, wherein the valve spool is configured to be actuated to perform a first draw of the predefined volume of fluid through the first opening and a second draw of a predefined volume of the fluid through the second opening.

3. The precision fluid-dispensing device of claim 2, wherein the valve manifold and valve spool are configure such that during performance of the second draw of the predefined volume of fluid the predefined volume of fluid of the first draw is concurrently dispensed through the first opening.

4. The precision fluid-dispensing device of claim 3, wherein the valve spool is configured to be actuated to perform a third draw of a predefined volume of fluid through the first opening, wherein during performance of the third draw the predefined volume of fluid of the second draw is concurrently dispensed through the second opening.

5. The precision fluid-dispensing device of claim 2, further comprising a rotary cylinder configured to engage the valve spool.

6. The precision fluid-dispensing device of claim 5, wherein the rotary cylinder is configured to be rotated in a first direction to cause the performance of the first draw and the rotary cylinder is configured to be rotated in a second direction to cause the performance of the second draw.

7. The precision fluid-dispensing device of claim 5, further comprising an attachment mechanism connecting the rotary cylinder to the valve manifold.

8. The precision fluid-dispensing device of claim 7, wherein the attachment mechanism comprises an adhesive.

9. The precision fluid-dispensing device of claim 7, wherein the attachment mechanism comprises a mechanical fastener.

10. The precision fluid-dispensing device of claim 2, wherein the first draw of the predefined volume of fluid moves the piston to the first end cap and the second draw of the predefined volume of fluid moves the piston to the second end cap.

11. The precision fluid-dispensing device of claim 1, further comprising a base connected to a portion of one or both the housing and the valve manifold.

12. The precision fluid-dispensing device of claim 11, wherein the base is anchorable to a foundation.

13. The precision fluid-dispensing device of claim 1, further comprising a first gasket configured to limit leakage of fluid flow between the housing and the valve manifold.

14. The precision fluid-dispensing device of claim 1, wherein the predefined volume of fluid is defined by a size of the interior cavity, a size of the first end cap, and a size of the second end cap.

15. The precision fluid-dispensing device of claim 14, wherein the predefined volume of fluid is further defined by a size of the piston.

16. The precision fluid-dispensing device of claim 15, wherein one or more of the first end cap, second end cap, and the piston are interchangeable with variable sizes of first and second caps and pistons, wherein the variable sizes change the predefined volume of fluid.

17. The precision fluid-dispensing device of claim 1, wherein the piston comprises an inert material.

18. The precision fluid-dispensing device of claim 1, wherein at least a portion of the precision fluid-dispensing device is autoclavable.

* * * * *